United States Patent [19]

Britz

[11] 4,171,791

[45] Oct. 23, 1979

[54] RELEASABLE MOLD FOR FORMING A RIBBED TRANSFORMER CASING

[75] Inventor: Leonard J. Britz, West Lafayette, Ind.

[73] Assignee: Duncan Electric Company, Lafayette, Ind.

[21] Appl. No.: 777,047

[22] Filed: Mar. 14, 1977

[51] Int. Cl.[2] ..... B28B 7/02; B28B 7/26

[52] U.S. Cl. ..... 249/156; 249/168

[58] Field of Search ..... 249/165, 126, 120, 139, 249/155, 156, 166, 167, 57, 59, 102, 119, 350, 154; 164/384, 401, 137, 339, 341, 391, 129, 168, 330, 340, 117, 126, 160, 163; 425/DIG. 30, 808; 264/297, DIG. 54, 219, 221

[56] References Cited

U.S. PATENT DOCUMENTS

| | | | |
|---|---|---|---|
| 1,577,132 | 3/1926 | Lawton | 249/168 |
| 1,707,152 | 3/1929 | Weymerskirch | 164/137 |
| 1,881,088 | 10/1932 | Matuschka | 249/156 X |
| 2,383,224 | 8/1945 | Sorenson | 164/350 |
| 2,574,593 | 11/1951 | Scharfe | 425/180 |
| 2,915,782 | 12/1959 | James | 249/160 X |
| 2,922,255 | 1/1960 | Broderick | 249/142 X |
| 3,656,539 | 4/1972 | Zickefoose | 164/129 X |

FOREIGN PATENT DOCUMENTS

| | | | |
|---|---|---|---|
| 6603787 | 9/1966 | Netherlands | 164/137 |

*Primary Examiner*—Richard B. Lazarus
*Assistant Examiner*—John S. Brown
*Attorney, Agent, or Firm*—John R. Nesbitt

[57] ABSTRACT

A releasable mold is disclosed for forming a ribbed transformer casing. The mold includes a plurality of sections first and second ones of which are endwise joined to form an annular ring. Each section has an inner portion with a concave face for forming an annular rib on a transformer casing formed by the mold with each section having an outwardly extending abutment on one opposite side portion and a recess on the other opposite side portion to receive the abutment on an adjacent section stacked thereagainst with the opposite side portions in engagement with one another to thereby accurately position the sections with respect to one another when so stacked and to thus allow a plurality of spaced annular ribs to be formed on the transformer casing. A plurality of fastening ears also extend from each section with each of the fastening ears being apertured to receive a fastening rod therein to releasably fasten the stacked and joined sections in position for forming the ribbed transformer casing.

8 Claims, 4 Drawing Figures

RELEASABLE MOLD FOR FORMING A RIBBED TRANSFORMER CASING

FIELD OF THE INVENTION

This invention relates to a releasable mold and, more particularly, relates to a releasable mold for forming a ribbed transformer casing.

BACKGROUND OF THE INVENTION

It is oftentimes necessary to provide a casing for devices such as electrical transformers intended for outdoor use. As is well known, such casings must be moisture proof, should be close to the transformer body and be of good thermally conductive material, and yet should present a maximum of surface area to the exterior of the transformer to facilitate cooling of the transformer.

While various forms of transformers have been heretofore encapsulated or otherwise encased (see, for example, U.S. Pat. Nos. 2,924,796; 3,041,562; 3,222,625; 3,388,363; 3,467,929; 3,493,908; 3,657,677; 3,742,411; 3,750,071; 3,821,678; 3,835,429; and 3,848,208), and while various materials have been suggested and/or utilized for encasing transformers (see, for example, U.S. Pat. Nos. 2,871,454; 3,762,939; 3,970,723; and 3,979,355), it has been found that a ribbed transformer casing (covering cooling fins or the like, for example) of epoxy material is often best suited for outdoor use.

Various methods and/or devices have also heretofore been suggested for providing the needed transformer casing. It has been found, however, that the heretofore known and/or utilized devices for forming transformer casings have not been completely satisfactory, particularly where a ribbed casing is needed, and improvements in such devices, including devices capable of providing ribbed transformer casings, have therefore been desirable.

SUMMARY OF THE INVENTION

This invention provides an improved device for forming a transformer casing, including forming ribbed transformer casings, and the improved device of this invention includes a releasable mold made from a plurality of sections joinable to form an annular ring with said sections being stackable so that each ring can form an annular rib on the molded transformer casing where desired.

It is therefore an object of this invention to provide an improved device for forming transformer casings.

It is another object of this invention to provide an improved device for forming ribbed transformer casings.

It is still another object of this invention to provide an improved releasable mold for forming transformer casings.

It is still another object of this invention to provide an improved releasable mold for forming ribbed transformer casings.

It is still another object of this invention to provide an improved releasable mold made from a plurality of sections.

It is yet another object of this invention to provide an improved releasable mold made from a plurality of sections joinable to form an annular ring for use in forming a transformer casing.

It is still another object of this invention to provide an improved mold made from a plurality of sections with cooperating means on the sides for enabling accurate stacking of the said sections.

It is yet another object of this invention to provide an improved releasable mold made from a plurality of stacked sections to enable formation of a transformer casing having a plurality of spaced ribs thereon.

It is still another object of this invention to provide an improved releasable mold made from a plurality of sections with fastening means for enabling releasable portions of said sections to be joined together during forming of said transformer casing.

With these and other objects in view, which will become apparent to one skilled in the art as the description proceeds, this invention resides in the novel construction, combination, and arrangement of parts substantially as hereinafter described, and more particularly defined by the appended claims, it being understood that such changes in the precise embodiment of the hereindisclosed invention are meant to be included as some within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
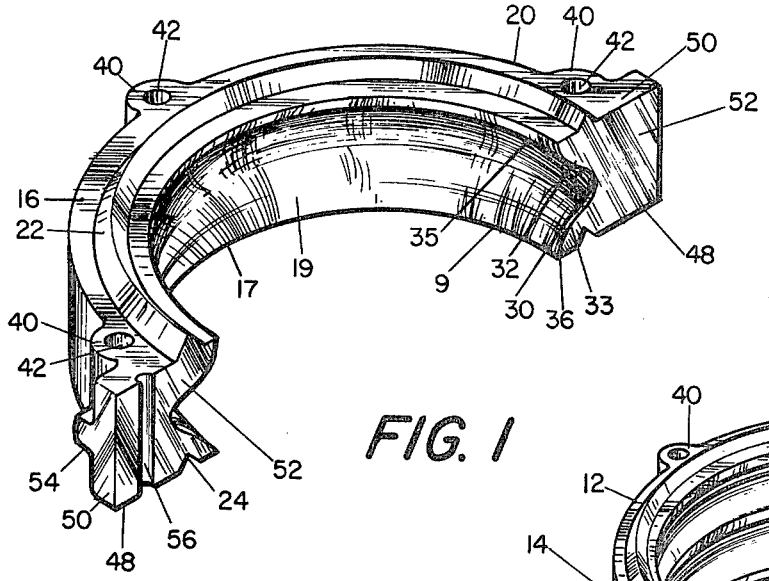
FIG. 1 is a perspective view of one section of the releasable mold of this invention.

Referring now to the drawings, the numeral 7 refers generally to the releasable mold of this invention. Mold 7 includes a plurality of sections, generally numbered 9, with one mold section 9 being shown in FIG. 1.

Figure 2:
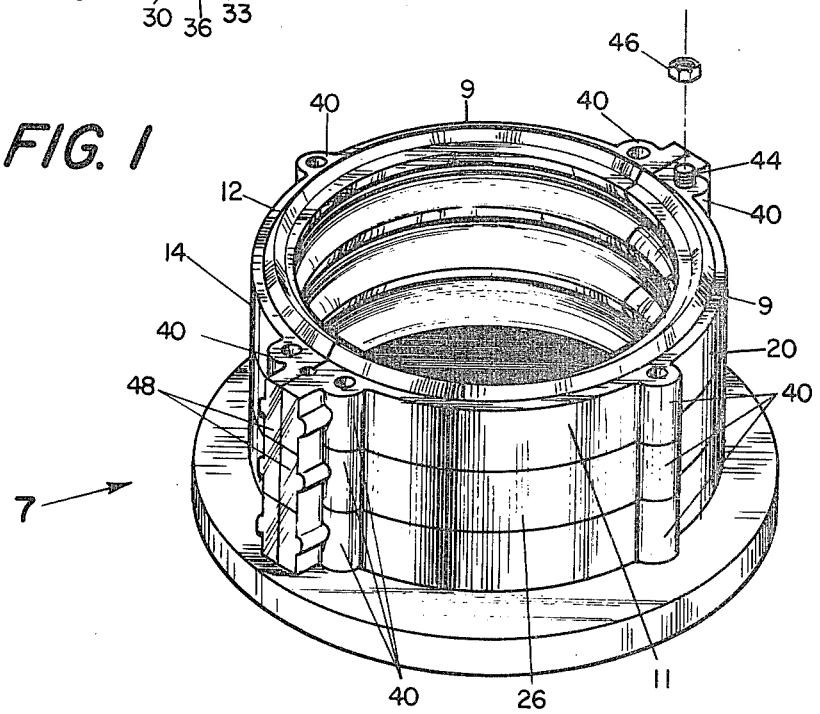
FIG. 2 is a perspective view of stacked and joined sections with a fastening rod joining the sections together to form a ribbed transformer casing.

As shown, each section 9 of releasable mold 7 is semicylindrical so that when two sections (numbered 11 and 12, as indicated in FIG. 2) are endwise joined an annular ring 14 is formed. While the dimensions of the mold will be dictated by the transformer casing needed, the mold may, for example, have an internal radius (i.e., between the inner faces of the mold) of about five inches and an external radius (i.e., between the back walls of the mold) of about 6.25 inches, with the thickness of the mold being about 1.228 inches.

Each section 9 has opposite side walls 16 and 17, an inner wall 19, and an outer wall 20. Side wall 16 has an outwardly extending abutment, or rib, 22 thereon with the rib 22 being preferably of generally triangular cross-section. Side wall 17, on the other hand, has a recess 24 therein with the recess also being preferably of generally triangular cross-section.

As can be appreciated, rib 22 of one section is intended to cooperate, or mate, with recess 24 in an adjoining section (numbered 11 and 26, as indicated in FIG. 2) when the sections are stacked with opposite side wall portions in engagement with one another. The cooperating rib and recess are therefore of like configuration so that the rib is tightly received within the recess to thus accurately position each section with respect to the adjacent section upon which stacking has occurred.

The rib and recess can, for example, be of a 45° triangular configuration with the rib extending outwardly (and the recess extending inwardly) for a distance of about 0.06 inches. This configuration could, of course, be modified as desired.

Figure 3:
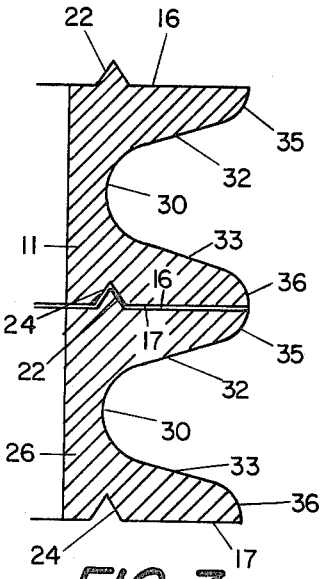
FIG. 3 is a cross section view showing two stacked sections.

Inner wall 19 of section 9 has a concave face to enable a rib 28 (see FIG. 4) to be formed on the transformer casing 29 when molded. If no rib is desired, then, of course, the face would be smooth or otherwise contoured as desired. As shown in FIGS. 1 and 3, the concave face of the inner wall 19 is formed in the center of the face by an arcuate center section 30, side walls 32 and 33, and oppositely curved end walls 35 and 36.

Figure 4:
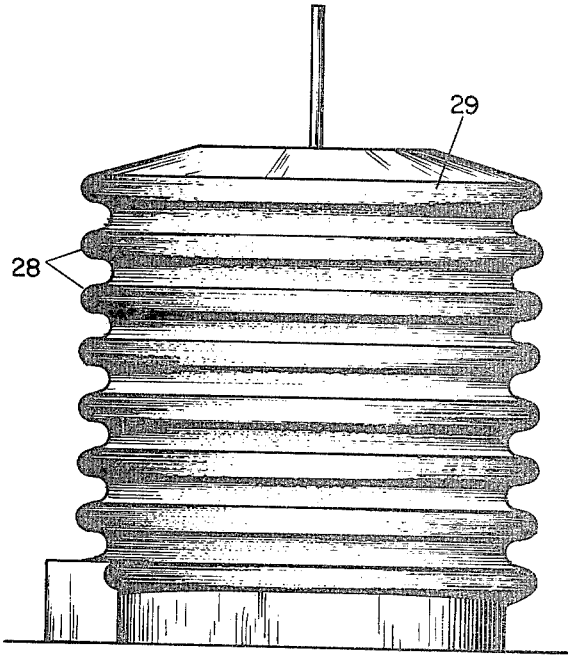
FIG. 4 is a side view of a ribbed transformer casing made by the releasable mold of this invention.

Arcuate section 30 preferably has a radius of about 0.312 inches, while side walls 32 and 33 preferably flare slightly outwardly toward the opposite side walls 16 and 17 at an angle of about 10°, and the end walls 35 and 36 are oppositely curved with respect to center section 30 and preferably have a radius of about 0.219 inches. This enables a smooth rib 28 to be formed on a molded transformer casing 29 and, of course, the configuration could be modified by suitable modifications of the concave face of the mold sections as would be obvious to one skilled in the art. As shown in FIG. 4, each rib 28 formed on the molded transformer casing 29 may be about equal to the space therebetween, and, for this to be accomplished, the concave portion of the face is about one-half of the total area of the inner wall with the concave portion being centered in the face.

Each section 9 has a plurality of fastening ears 40 formed thereon for fastening of the sections in place for molding of the transformer casing. As shown in FIGS. 1 and 2, fastening ears 40 are spaced about the sections and extend outwardly away from the inner face. Each ear has an aperture, or bore, 42 extending therethrough so that a fastening rod, or bolt, 44 can extend through the apertures to hold the sections in place. If desired, a nut 46 can be placed on the bolt to releasably secure the sections in position with respect to one another.

Feet 48 are provided at the ends of each section to facilitate endwise joining of the sections to form an annular ring. As shown in FIG. 1, each foot 48 has a flared shoulder 50 and a flat joining face 52 for endwise engagement between sections. A reinforcing rib 54 is located on the rear side of shoulder 50, and the face may have a notch 56 therein for mating with a rib (not shown) on a mating section to insure proper endwise engagement between sections.

For operation, the releasable mold is first assembled by placing sections in endwise engagement to form an annular ring, and the sections are stacked one upon another with opposite side walls in engagement with as many sections being stacked as is desirable to form the desired number of ribs 28 on the molded transformer casing 29, which ribs can, for example, correspond to the number of cooling fins on the transformer to be covered (i.e., eight pairs of sections would be utilized to mold a transformer casing needing eight ribs). The sections are stacked as shown in FIG. 2 and the cooperating rib 22 and recess 24 accurately position the sections as shown in FIG. 3 so that smooth ribs are formed on the molded transformer casing. When so assembled, the sections are then fastened into position by rods 44 extending through the apertures in fastening ears 40.

The transformer casing is then molded onto the transformer which is placed within the releasable mold 7 in conventional manner, with epoxy material in liquid form, for example, being brought into contact with the inner faces 19 of the mold sections to form the outer casing of the transformer. With the faces 19 having concave portions, ribs are thus formed and retained upon curing of the epoxy material into a solid state. Obviously, the material used for the casing should be thermally conductive material to allow the heat generated within the transformer to be dissipated to the ambient environment, particularly where the casing covers cooling fins. After the epoxy material has cured, the mold sections are then released by removing the fastening rods, after which the sections are removed from around the transformer casing.

As can be appreciated from the foregoing, this invention provides an improved releasable mold for forming a transformer casing, and more particularly for forming a ribbed transformer casing.

What is claimed is:

1. A releasable mold for forming a ribbed transformer casing, said mold comprising a plurality of joinable sections each of which includes first and second elements positionable in an annular ring configuration with said sections having opposite side portions and an inner portion with a concave face for forming an annular rib on a transformer casing formed by said mold when said sections are positioned in said annular ring configuration, said sections also having cooperating means on said opposite side portions for accurately positioning said sections when stacked with said side portions of different sections of said mold in engagement with one another so that said mold causes a plurality of said annular ribs to be present on a transformer casing formed by said mold with said stacked sections.

2. The releasable mold of claim 1 wherein said cooperating means includes an outwardly extending abutment of predetermined configuration on one of said opposite side portions of said sections and a recess in the other of said opposite side portions of said sections with said recess being of a configuration to receive said abutment of a different one of said sections when stacked with said one of said opposite side portions in engagement therewith.

3. The releasable mold of claim 2 wherein said abutment is of triangular configuration and wherein said recess is of a like triangular configuration for receiving said abutment therein in tight relationship.

4. The releasable mold of claim 1 wherein said mold includes mold fastening means for releasably securing said sections in said annular ring configuration.

5. The releasable mold of claim 4 wherein said mold fastening means extends through a plurality of stacked sections of said mold to releasably secure said sections in said stacked relationship.

6. The releasable mold of claim 5 wherein said mold fastening means includes apertured ears extending from each of said sections and removable rod means received in said apertures in said ears.

7. The releasable mold of claim 1 wherein said inner portion has said concave face formed therein at the center of said inner portion so that a rib is enabled to be formed in a transformer casing that is equal to approximately one-half of the width of said section.

8. A releasable mold for forming a ribbed transformer casing, said mold comprising a plurality of stacked sections each of which includes first and second elements positionable in an annular ring configuration with each of said sections having an outwardly extending substantially triangularly shaped rib on one side portion and a substantially triangularly shaped recess in the opposite side portion for receiving and mating with said rib on an adjacent stacked mold having said side portions in engagement with one another, each of said sections also having an inner portion with a concave face for forming annular ribs on a transformer casing formed by said releasable mold, and each of said sections having a plurality of fastening ears adapted to receive fastening means for releasably fastening said stacked sections in position for use in forming said transformer casing.

* * * * *